United States Patent [19]

Houlihan et al.

[11] Patent Number: 4,783,773

[45] Date of Patent: Nov. 8, 1988

[54] REGATTA TIMING WATCH

[75] Inventors: John T. Houlihan, Watertown, Conn.; T. Fred Olsen, Oslo, Norway; Tom Thinesen, Sunnyvale, Calif.

[73] Assignee: Timex Corporation, Waterbury, Conn.

[21] Appl. No.: 207,826

[22] Filed: Jun. 17, 1988

[51] Int. Cl.[4] ..... G04F 8/00; G04C 17/02

[52] U.S. Cl. ..... 368/108; 368/240

[58] Field of Search ..... 368/107–113, 368/240

[56] References Cited

U.S. PATENT DOCUMENTS

| | | | |
|---|---|---|---|
| 3,980,868 | 9/1976 | Thompson | 235/92 |
| 4,079,369 | 3/1978 | Fukumoto | 340/324 |
| 4,245,335 | 1/1981 | Wiesner | 368/70 |
| 4,255,806 | 3/1981 | Fahrenschon et al. | 368/240 |
| 4,385,482 | 5/1983 | Wiesner | 368/240 |
| 4,742,501 | 5/1988 | Coster | 368/107 |

*Primary Examiner*—Vit W. Miska

*Attorney, Agent, or Firm*—William C. Crutcher

[57] ABSTRACT

Briefly stated, the invention is practiced by providing a wristwatch with a case having manually actuated switches, a microcomputer in the case responsive to the switches, an annunciator responsive to the microcomputer, and an electrooptic display having a set of first segments arranged to provide digits and a set of second circumferentially spaced radial segments surrounding the first segments. The microcomputer is programmed to provide several modes of operation, such as a time of day mode, a timer mode, a chronograph mode, and a ratio calculation mode. The time of day mode is arranged to display local time of day on the first segments and time in another time zone on the second segments. The timer mode is arranged to display the time remaining in a countdown time period selected by manually actuating one of the switches. The time remaining is displayed on the first segments while local time of day is displayed on the second segments. The timer mode is further arranged in the last stage of the countdown time period to stop displaying time of day on the second segments and to initiate a sequential cumulative actuation of the second segments in a prescribed pattern which indicates imminent start of the race.

14 Claims, 6 Drawing Sheets

ANNUNCIATOR - 5 MINUTE MARKS

ANNUNCIATOR - MINUTE MARKS

ANNUNCIATOR - WARNING MARKS

ANNUNCIATOR - FINAL 15 SECONDS

ANNUNCIATOR AUDIBLE SWITCH CLOSURES

ANNUNCIATOR - TURN SIGNAL

REGATTA TIMING WATCH

BACKGROUND OF THE INVENTION

This invention relates generally to a wristwatch especially adapted for participants in a sailing regatta, and more particularly to a wristwatch especially adapted to assist preparation and positioning of the boat prior to starting of the race.

Electronic timepieces are known in which time of day is displayed both in digital fashion on a seven-segment digit display and in analog fashion by a ring of radial segments on the electrooptical display simulating the hands of a mechanical watch. Wristwatches are also known which are adapted to assist in preparation for a regatta by providing hands or digits arranged to count down a time period remaining before the start of a race. One such known starting watch provides a 15 minute countdown covering three zones. A chronometer has been described, which controls the preparation time preceeding the start of regattas using a hand designed to move at a first speed over one dial sector and at a second faster speed over a second dial sector, this proposed chronometer being shown in published British patent application No. 2183373A.

In preparation for the start of a regatta, a warning signal from the committee boat initiates a time period of a known time remaining prior to start of the race, usually 5 minutes. It is then up to the participants to maneuver their boats so as to arrive just behind the starting line sailing at full speed, but not to cross the starting line before the race starts.

It is a known preparatory technique in regattas to first record the time when sailing on a "reach" downwind from the starting line and then to reverse heading and record the time on a "tack" back to the starting line, making appropriate calculations to derive a ratio and then applying the same ratio to a subsequent passage on the same two headings. Assuming no change in wind or water conditions, this enables one to determine the proper time to reverse course so as to arrive at the starting line on time. This technique, however, requires a stopwatch and a requirement to make calculations with the possibility of error.

Timepieces with alarms or annunciators to signal a predetermined event or passage of time are also known. However, it is not always possible to distinguish the significance of one annunciator signal from the next.

Accordingly, one object of the present invention is to provide an improved wristwatch for controlling the maneuvering of a boat preceding the start of a regatta.

Another object of the invention is to provide an improved type of display for a regatta timing watch with improved coordination of visual and aural indications of time remaining before the start of the race.

Another object of the invention is to provide an improved device for signaling the proper time to reverse course in order to reach the starting line on time.

SUMMARY OF THE INVENTION

Briefly stated, the invention is practiced by providing a wristwatch with a case having manually actuated switches, a microcomputer in the case responsive to the switches, an annunciator responsive to the microcomputer, and an electrooptic display having a set of first segments arranged to provide digits and a set of second circumferentially spaced radial segments surrounding the first segments. The microcomputer is programmed to provide several modes of operation, such as a time of day mode, a timer mode, a chronograph mode, and a ratio calculation mode. The time of day mode is arranged to display local time of day on the first segments and time in another time zone on the second segments. The timer mode is arranged to display the time remaining in a countdown time period selected by manually actuating one of the switches. The time remaining is displayed on the first segments while local time of day is displayed on the second segments. The timer mode is further arranged in the last stage of the countdown time period to stop displaying time of day on the second segments and to initiate a sequential cumulative actuation of the second segments in a prescribed pattern which indicates imminent start of the race. An annunciator is coordinated to provide different types of signals designed to assist the participant in the regatta. A ratio calculation mode provides for calculation of a ratio of reach time to tack time, abbreviated herein to r/t ratio, which is an arbitrarily selected name. The r/t ratio is calculated on a trial run along an arbitrarily selected reaching course and a tacking course on a reverse heading. This r/t ratio is stored and subsequently used to calculate the proper time to turn and reverse course in order to reach the starting line on time.

DRAWINGS

The invention, both as to organization and method of practice, together with further objects and advantages thereof, will best be understood by reference to the following description taken in connection with the accompanying drawings, in which:

FIG. 1 is a simplified plan view of the improved regatta timing watch,

FIG. 2 is a schematic circuit drawing of the microcomputer, annunciator, switches, display, and other circuit elements, FIG. 3 is a block diagram indicating basic operation modes of the regatta timing watch, FIG. 4 is a detailed block diagram illustrating states of operation while in the timer and ratio calculation modes, FIG. **4*a* is a block diagram indicating operation in the timer mode using the r/t ratio, FIG. 5 is a schematic diagram illustrating a typical sequence of display appearances just prior to start of a race, FIGS. 6*a*–6*f* depict wave shapes of signals actuating the annunciator, and FIG. 7** is a diagram illustrating a trial run and a final run in the regatta.

DESCRIPTION OF THE PREFERRED EMBODIMENT

Figure 1:
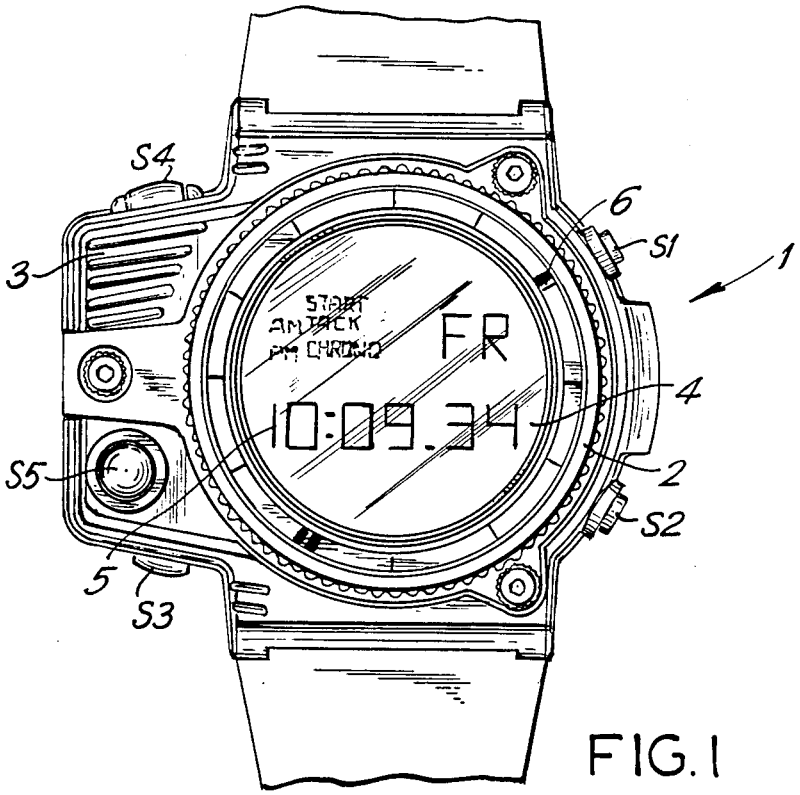

Referring now to FIG. 1 of the drawing, the regatta timing watch 1 includes a case 2, with an offset or extension 3. An annunciator is provided comprising a piezoelectric element (not shown) mounted on an acoustic sounding board inside the case, which serves as a resonator to increase the decibel level provided by the annunciator. A number of side mounted manually actuated switches preferably implemented as push button switches S1, S2, S3, and S4 and a top mounted manually actuated push-button switch S5 are located on the case and arranged to close spring metal contacts internally in a manner well-known in the art. Push button S5 is preferably a distinctive color such as red to make it easy to locate and is mounted on the extension 3 to make it easy to use. An electrooptical display is disposed in the top of the case, typically a liquid crystal display, and is divided into a first inner set of actuatable segments 5 for displaying characters and a second surrounding set of actuatable segments 8 for displaying analog patterns.

Figure 2:
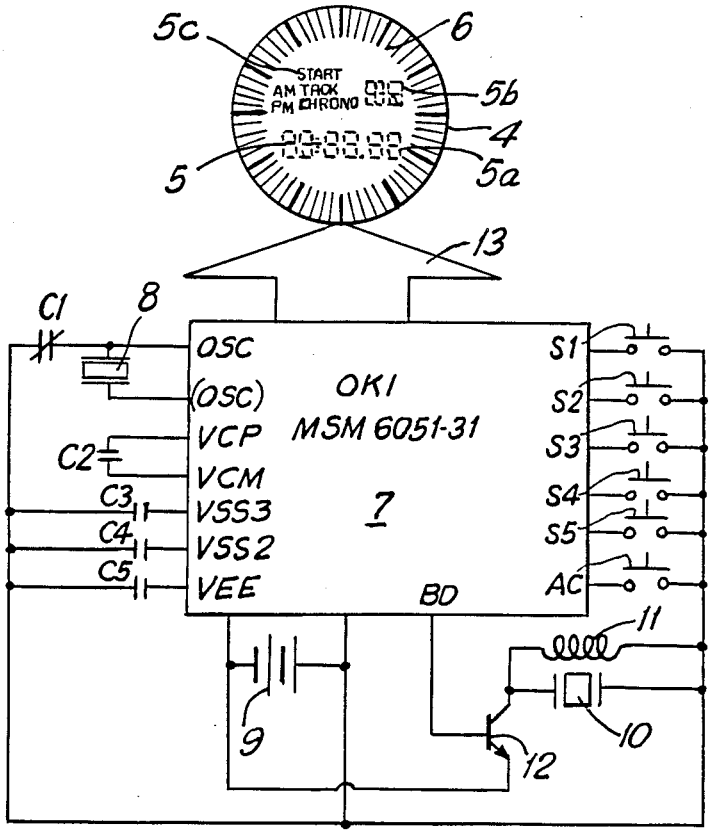

FIG. 1 depicts the watch 1 in normal timekeeping or time of day mode. The first segments 6 are displaying local time of day digitally as 10:09 while the second segments are displaying time in a second time zone as 7:09 in an analog fashion. Referring now to FIG. 2 of the drawing the schematic block diagram illustrates an integrated circuit 7, which is a commercially available mask-programmable microcomputer chip, hereinafter designated a microcomputer, having internal microprocessor, RAM and ROM memory, input and output circuits, LCD display drive circuits, and programmed instruction sets. Such microcomputers are readily available from several sources, but a suitable microcomputer for the present application is Part Number MSM6O51-31, supplied by Oki. Such microcomputers may be programmed through the use of masks during the final stages of the production process to perform standard instructions in the manner of a known computer.

Also shown in the FIG. 2 schematic drawing are the schematic circuit representations of the manually actuated switches Sl, S2, S3, S4, and S5 and a simplified representation of the electrooptic display 4. An internal switch AC is used for resetting the registers in the microcomputer and is not material to the invention. Enclosed in the watchcase 2 with the integrated circuit 7 and the electrooptic display 4 are a number of additional circuit elements which are well-known to those skilled in the art and normally understood to be part of the operational parts of a digital wristwatch circuit. These are quartz crystal 8 serving as a timebase connected to pins labeled OSC and (OSC). A battery power source 9 is provided in the form of a button type energy cell in the watchcase. The annunciator serving both as a watch alarm and race annunciator is made up of a piezoelectric crystal 10, inductance coil 11 and drive transistor 12, which is connected to be responsive to the microcomputer 7.

A trimmer capacitor C1 adjusts the oscillator frequency. Several fixed value capacitors C2 through C55 combined with other circuit elements inside the microcomputer 7 serve to boost the output voltage to drive the electrooptic display 4 through a display driver bus 13. Bus 13 represents the several parallel leads connected to the various actuatable segments of the electrooptic display.

The first segments 5 of the electrooptic display are arranged in patterns to provide alphanumeric characters. A pattern may either be 7 segment arrangement, such as 5*a*, to provide a digit, or a more complex pattern as indicated at 5*b* which provide either alphabetic or digital characters. The display may also include a number of connected letters to be actuated to display an entire word as shown at 5*c*.

The second segments 6 surrounding the first segments are arranged in a ring or circle of radially extending circumferentially spaced segments, which are 60 in number in the preferred embodiment so that each minute of an hour may be indicated by actuating a segment. The hours may be indicated and distinguished from minutes by simultaneously actuating two adjacent segments.

Figure 3:
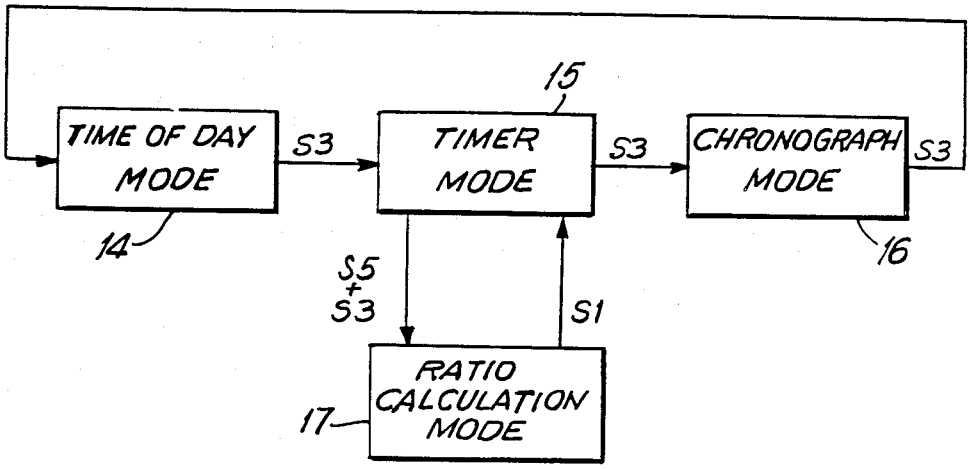

FIG. 3 is a block diagram indicating in very general form the various basic modes of operation provided by the timepiece. These are a time of day mode 14, a timer mode 15, a chronograph mode 16, and a ratio calculation mode 17. Each block of the FIG. 3 diagram indicates a mode of operation of the timepiece. Change from one mode to the next is accomplished by actuating one or more of the manually actuated switches, here the switch S3. The operation of electronic timepieces in "time of day" mode and in "chronograph" mode is well-known in the art and not discussed in any detail in this application. A detailed diagram of the "timer" and "ratio calculation" modes, however, is shown in FIG. 4, which depicts a "state" diagram in schematic form. Each of the rectangles in FIG. 4 represents a "state" of operation with a representative digital display shown on the first segments 5 of the electrooptic display 4 when the instrument is in that "state." The instrument continues to operate in one state under control of the particular sub-routine of the program which is preprogrammed into the microcomputer, until the instrument is placed in another state. Change from one state to another or into another mode, may be initiated by actuation of a manual actuator as indicated by a switch number S1 through S5 adjacent the appropriate line outside of the rectangle.

Referring to FIG. 4, the left hand column of "state" blocks represents the timer mode and the right hand column of blocks represents the ratio calculation mode. First, commencing with the timer mode, the states designated by the blocks are a "timer mode entry" state 18, a "timer setting" state 19, a "start timer" state 20, a "10 second correction" state 21, and a "5 minute correction" state 22. The times displayed are counting down to zero, commencing with a selected countdown period which is set while in the "timer setting" state 19.

Next, on the right hand side of FIG. 4 in the ratio calculation mode are successively a "ratio calculation entry" state 23, a "start" state 24, a "turn" state 25, an "end" state 26, and an "r/t ratio display" state 27. The times displayed are counting up from zero time when the start state is commenced by pressing actuator S5. However, the basic countdown continues, but is not displayed except in the timer mode.

The last set of blocks show states in the timer mode which can be entered only after the r/t ratio has been calculated and stored. These are shown successively as a "timer re-entry" state 28, a "time remaining calculation" state 29, a "hold" state 30, and a "renew calculation" state 31.

Figure 4A:
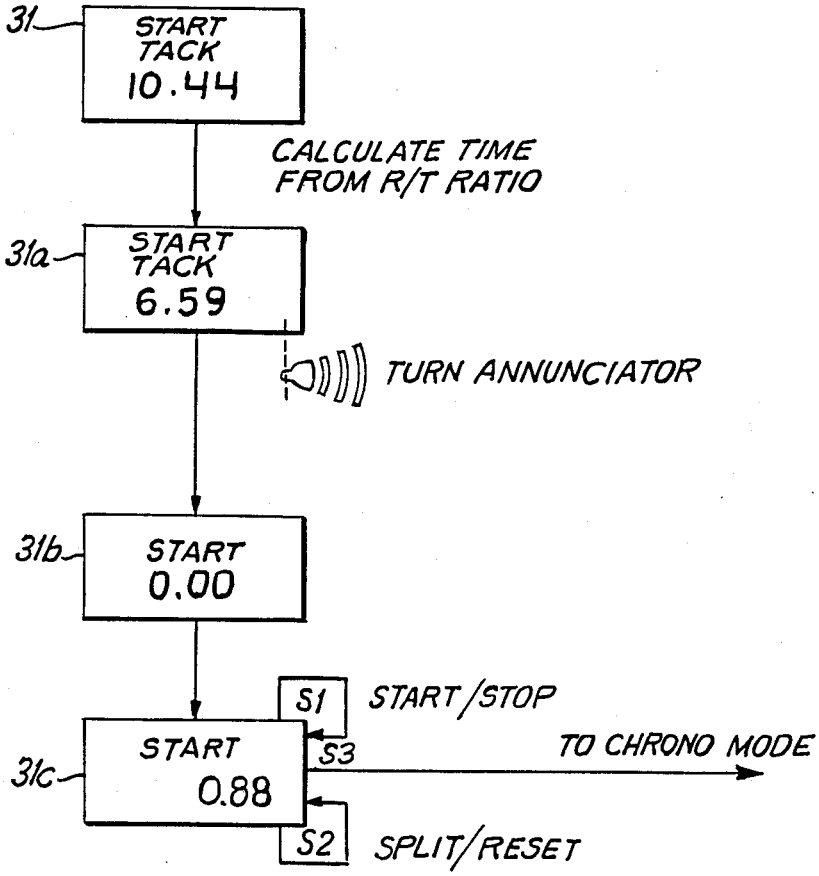
Figure 4:
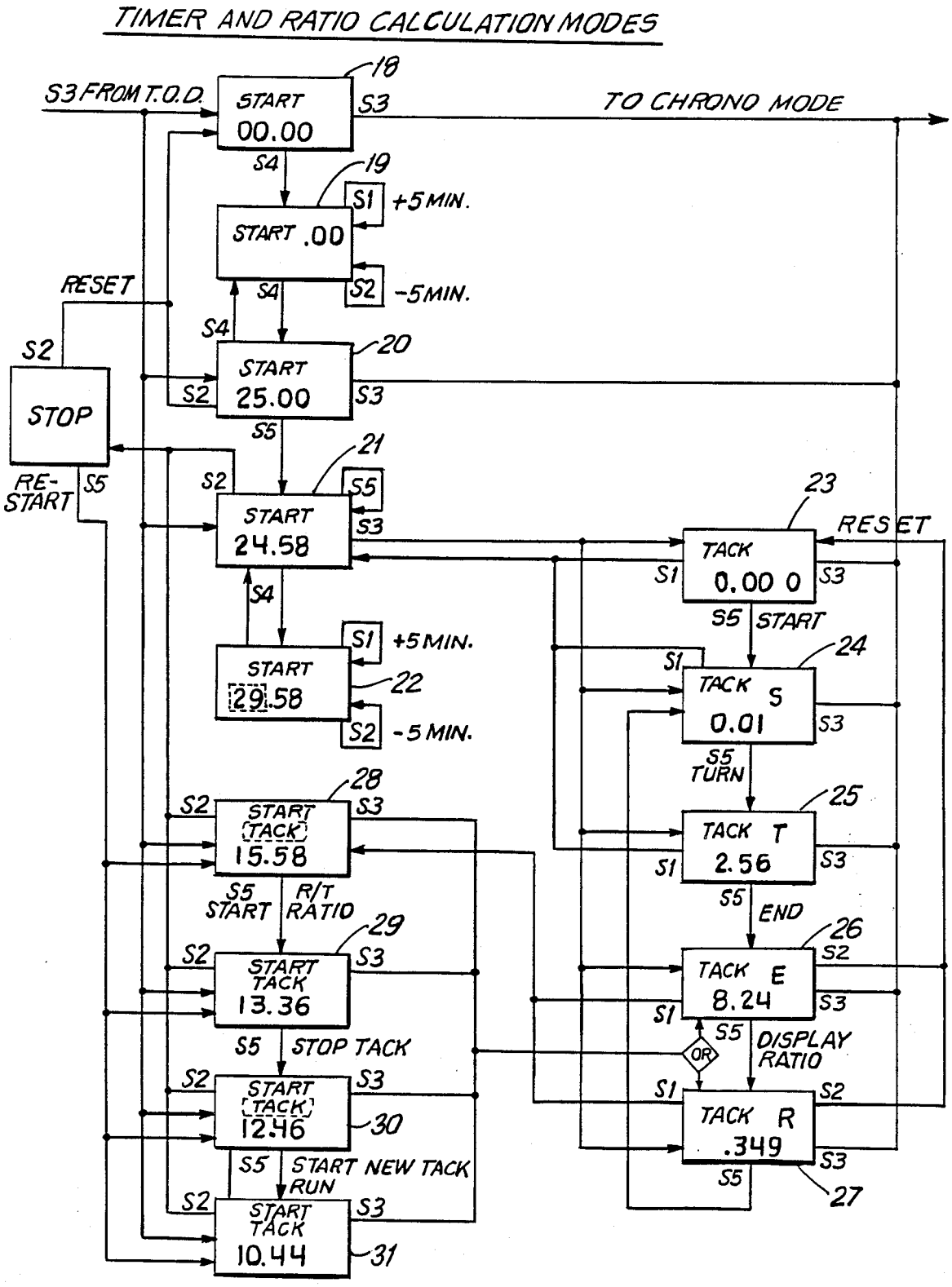

FIG. 4*a* of the drawing is a block diagram illustrating the appearance of the display during a representative final run, while in the timer mode, and after calculation of an r/t ratio. The microcomputer is programmed to calculate an r/t ratio from the elapsed times (displayed on the first segments) by successively actuating switch S5 as the timer counts down toward zero. The times at which the switch is actuated are denoted "s", "t", and "e". These times correspond to points S, T and E during a trial run on the course (see FIG. 7). These times are shown in minutes and seconds on the display and are also stored in microcomputer memory. The following calculation is performed:

$$r/t \text{ ratio} = (t-s)/(e-s), \text{ where } s=0$$

This provides a r/t ratio, which is also stored in memory.

Subsequently, a time remaining to start on the final leg, designated "f" is indicated on the display and stored in memory by actuating a switch. Application of the following calculation determines time to turn.

$$\text{turn time} = f - (r/t * f)$$

This calculation provides turn initiation time as shown at 31*a*, at which time an annunciator is caused to sound by a program in the microcomputer. A turn is initiated by the race participant, coming to new heading on a reverse course. The timer continues to run until start time indicated in rectangle 31*b*. If the timer continues to run without resetting, it starts counting up instead of down to indicate the total time of the race on the display as shown at 31*c*.

Figure 5:
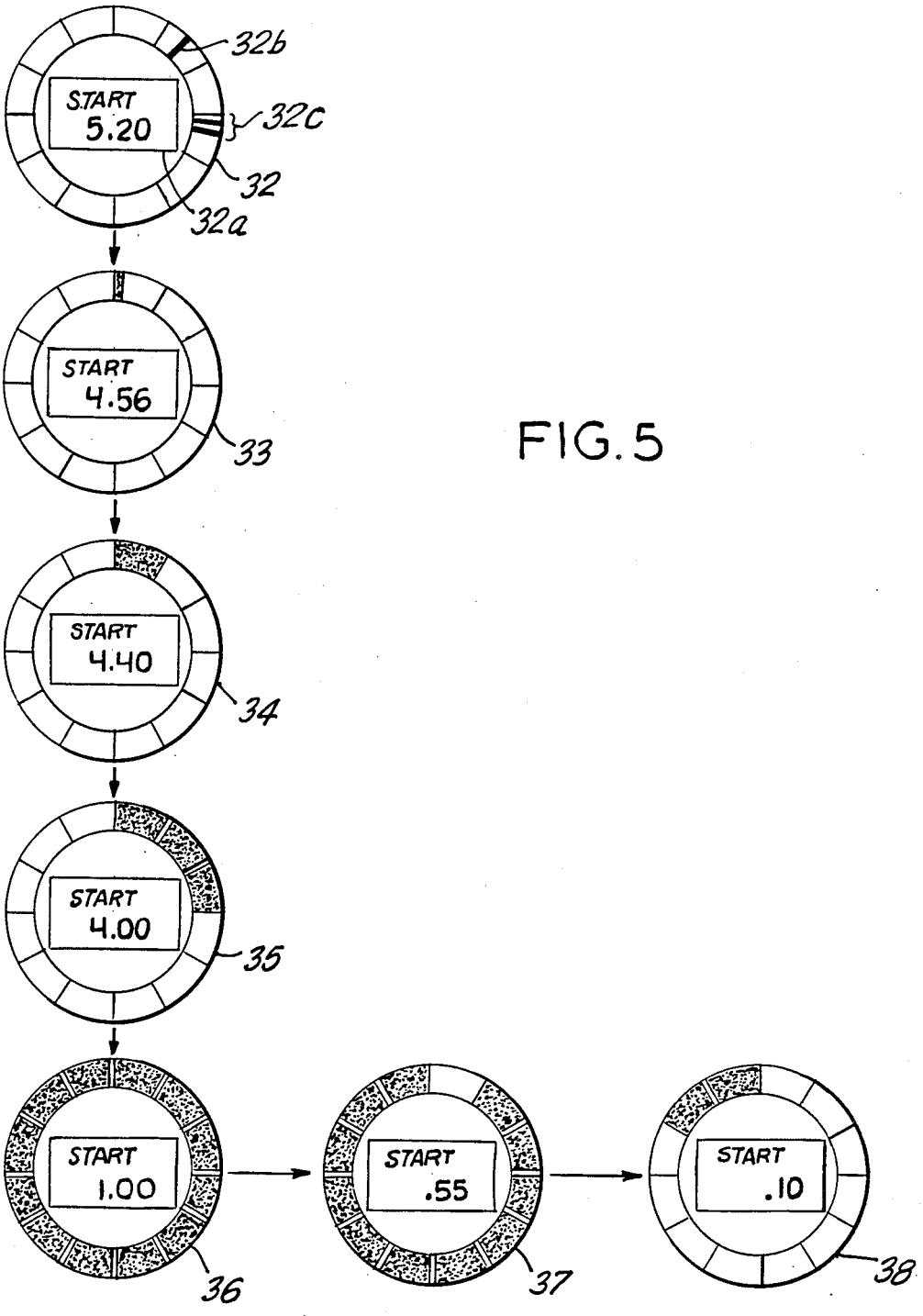

FIG. 5 depicts a time sequenced series of illustrations showing how the display depicts the last stage of the selected countdown period, in this case the last 5 minutes, by actuating the outer or second segments in a predetermined sequential and cumulative manner. The microcomputer is programmed using known techniques to successively cause the driver circuits to actuate segments as the internal timekeeping circuit reaches times which correspond to times selectively preprogrammed in the microcomputer non-volatile memory during the manufacturing process.

The successive displays are indicated by reference numerals 32–38. Time remaining before the start of the race, while in the timer mode, is indicated digitally by the first segments as shown at 32*a*. The local time of day is indicated on the outer ring of second segments by selectively actuating the second segments to provide a minute hand 32*b* composed of one segment and an hour hand 32*c* composed of two segments, thereby distinguishing between them.

During the last 5 minutes the second segments cease indicating the time of day and commence to be actuated cumulatively in a clockwise direction at the rate of 1 segment every 4 seconds. After 20 seconds, 1/12 of the total circumference is filled as indicated in display 34. After 1 minute, ¼ of the display is filled as indicated in display 35. After 4 minutes, all of the second segments are actuated so that the display appears as in reference 36, showing a full ring of actuated (dark) segments.

Subsequently, the segments are deactivated in a clockwise direction at a second (or faster) rate. One segment is deactivated every second. After 5 seconds, the display appears as shown at 37, and when there are 10 seconds to go, it appears as seen at 38. In other words, the segments are deactivated at a rate 4 times as fast they are actuated, which assists in alerting the participant and making final maneuvering adjustments at the start of the race.

Figure 6A:
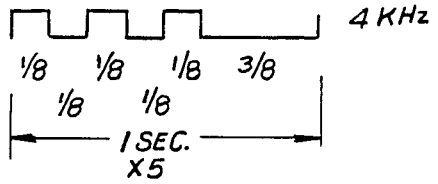

The visual appearance is coordinated with aural signals. Referring to FIGS. 6*a*–6*f*, distinctive annuciator sounds are provided by the various wave forms shown. A high level indicates a drive signal to the piezoelectric transducer with a tone of approximately 4 kHz and a low level indicates absence of a signal and absence of a tone. For example, the wave form of FIG. 6*a* provides 3 uniform beeps and a silent period, all in the space of 1 second, and repeated 5 times. The signal at 6*c* produces a long beep and a short beep followed by a silent period during the space of 1 second, repeated 3 times. The annunciator turn signal at 6*f* is a long sound for ⅞ of second and a silent period for ⅛ of a second, repeated three times.

Figure 6B:
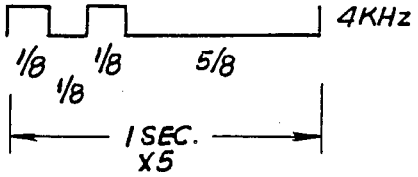
Figure 6C:
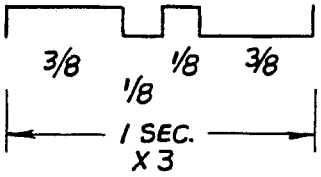

The foregoing wave forms are coordinated with the mode and state desired so as to distinguish the state. In the case of FIGS. 6*a*, 6*b*, and 6*c*, the sound precedes the change of the display by a preselected time period so that the participant is warned to look at the display. The wave form of FIG. 6*a* is sounded at 5 seconds prior to each 5 minute mark. The wave shape of FIG. 6*b* is sounded at 5 seconds prior to each minute mark during the last 5 minutes. The wave shape of FIG. 6*c* sounds at three seconds prior to the 1 minute, 45 second, 30 second, 25 second, and 20 second marks.

During the final 15 seconds, the wave shape of 6*d* causes beeping sounds precisely on the second and then produces a steady tone continuously during the last 5 seconds.

Figure 6D:
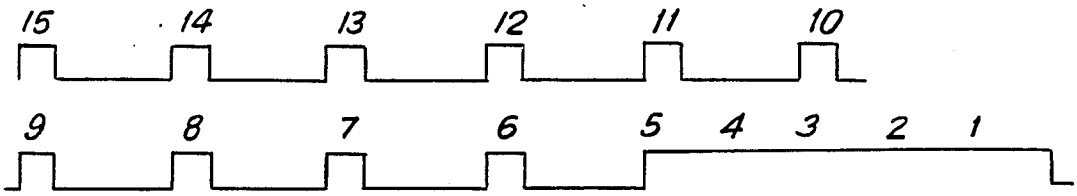
Figure 6E:
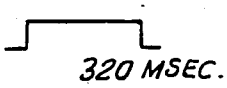
Figure 6F:
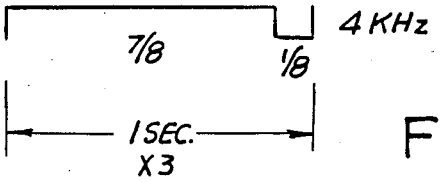

Audible switch closures are provided by short pulses as in FIG. 6*e*. The annunciator signal to initiate the turn on the final run is produced as shown in FIG. 6*f*.

OPERATION

Figure 7:
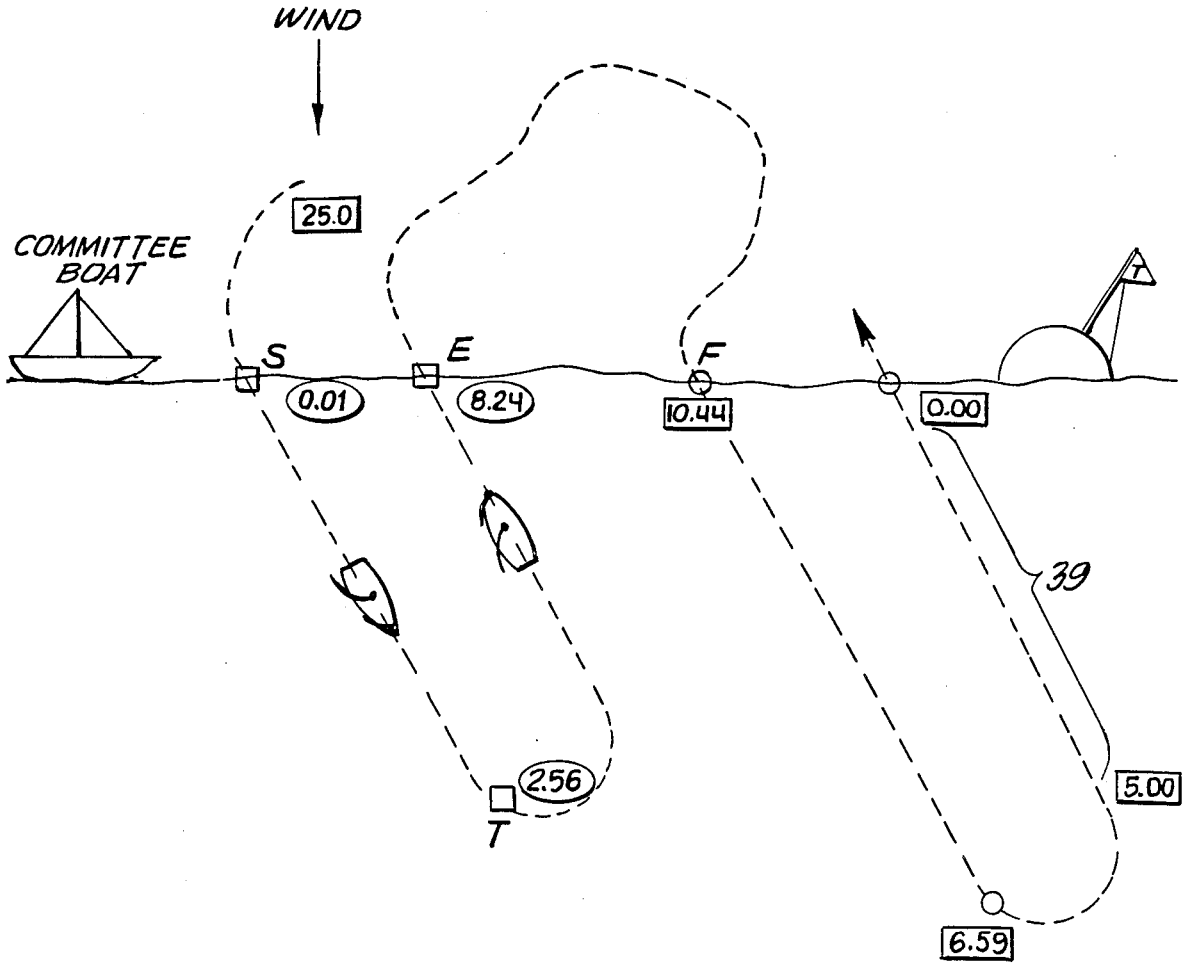

Operation of the improved regatta timing watch may be understood by reference to FIG. 7. At some time prior to the race, the timer mode is entered from the time of day mode by pressing switch S3 (See FIG. 4). A preselected time period in 5 minute increments is set in block 19. In the example shown, at a signal 25 minutes from start, the timer countdown is started by actuating the top mounted switch S5. The count down times are displayed in rectangles in FIG. 7. As the trial run is commenced, the ratio calculation mode is entered and S5 is actuated at points S on the starting line, T at initiation of turn, and E upon crossing the starting line on a reverse heading. Using the counting up times displayed in elliptical boxes t (at point T) and (e at point E), the r/t ratio is calculated by the microcomputer as 0.349, displayed, and stored in microcomputer memory.

For the purpose of the illustration, it is assumed that the r/t ratio has been calculated at 0.349 as indicated in block 27 of FIG. 4, and that the final run has started at count down time 10.44 (10 minutes and 44 seconds) as indicated in block 31 of FIG. 4.

Once the r/t ratio has been computed and displayed, the timer mode is re-entered at block 28 and the final run is commenced at point F at 10.44 on the same heading as the trial run. The annunciator sounds (FIG. 6*f*) at the calculated turn initiation time of 6.59. During the final 5 minutes along the path to the starting line indicated at 39 in the drawing, the outer segments cease displaying time of day and commence a visual indication of imminent start of the race by the display of time remaining as shown in FIG. 5. This display is coordinated with warnings from the annunciator as indicated in FIGS. 6*b*–6*d*.

While there has been described what is considered to be the preferred embodiment of the invention, other modifications will occur to those skilled in the art, and it is desired to secure in the appended claims all such modifications as fall within the true spirit, and scope of the invention.

We claim:

1. An improved regatta timing watch, comprising:

a case having a plurality of manually actuated switches, and having a microcomputer in said case responsive to said switches, and having an annunciator in said cases responsive to said microcomputer, an electrooptical display disposed in said case and having a plurality of first actuatable segments arranged to display digits and a plurality of second actuatable circumferentially spaced radial segments surrounding said first segments, said microcomputer being programmed to provide a time of day mode adapted to generate and display the time of day on said first segments, and a timer mode initiated in response to actuation of at least one of said switches, said timer mode being adapted so as to display time of day on said second segments and to display on said first segments the time remaining in a selected countdown period, said countdown period being selected in response to actuation of at least one of said switches.

2. The combination according to claim 1, wherein said microcomputer is adapted upon occurrence of a preselected remaining time in said selected countdown period to cease displaying time of day on said second segments and to sequentially actuate said second segments in a predetermined pattern to indicate time remaining before start of a race.

3. The combination according to claim 2, wherein said microcomputer is programmed to actuate said second segments both cumulatively and circumferentially in sequence.

4. The combination according to claim 3, wherein said second segments are cumulatively actuated at first intervals of time and cumulatively deactivated at second shorter intervals of time.

5. The combination according to claim 1, wherein said annunciator is driven by a first signal from said microcomputer to provide a first distinctive sound in a manner which is coordinated with actuation of preselected intervals displayed on said first segments when the second segments are displaying time of day.

6. The combination according to claim 2, wherein said annunciator is driven by a second signal from said microcomputer to provide a second distinctive sound in a manner which is coordinated with actuation of preselected intervals displayed on said first segments when the second segments are displaying said predetermined pattern.

7. The combination according to claim 1, wherein said annunciator is driven by signals from said microcomputer to provide distinctive sounds at a preselected interval before display of preselected times on said segments.

8. The combination according to claim 1, wherein said microcomputer is programmed to provide a ratio calculation mode, wherein a first time interval on a first sailing course and a second time interval on a second sailig course may be selected by actuation of a selected one of said switches, said microcomputer being adapted to compute and store a ratio of said first and second time intervals.

9. The combination according to claim 8, wherein said ratio is displayed on said first segments.

10. The combination according to claim 8, wherein said first and second time intervals are displayed on said first segments while counting up from a zero time initiated by said selected switch.

11. The combination according to claim 8, wherein said microcomputer is adapted to calculate a turn time by multiplying said ratio by time remaining in said selected countdown period before start of a race.

12. The combination according to claim 11, wherein said annunciator is driven by a third signal from said microcomputer to provide a third distinctive sound at said turn time.

13. The combination according to claim 1, wherein said microcomputer in the time of day mode is adapted to generate and display the time of day on both said first and second segments.

14. The combination according to claim 13, wherein the local time of day is displayed digitally on the first segments while the time in another time zone is displayed analog fashion on said second segments.

* * * * *